US009343201B2

(12) United States Patent
Arzate et al.

(10) Patent No.: US 9,343,201 B2
(45) Date of Patent: May 17, 2016

(54) METHOD FOR MANUFACTURING A REINFORCED OVERHEAD MULTIPURPOSE CABLE FOR OUTSIDE TELECOMMUNICATION

(71) Applicants: Fermin Marquez Arzate, Queretaro (MX); Victor Osornio Osornio, Queretaro (MX)

(72) Inventors: Fermin Marquez Arzate, Queretaro (MX); Victor Osornio Osornio, Queretaro (MX)

(73) Assignee: SERVICIOS CONDUMEX S.A. DE C.V., Gueretara (MX)

( * ) Notice: Subject to any disclaimer, the term of this patent is extended or adjusted under 35 U.S.C. 154(b) by 83 days.

(21) Appl. No.: 13/999,301

(22) Filed: Feb. 8, 2014

(65) Prior Publication Data

US 2014/0367142 A1 Dec. 18, 2014

Related U.S. Application Data

(62) Division of application No. 10/898,509, filed on Jul. 22, 2004, now abandoned.

(30) Foreign Application Priority Data

Mar. 26, 2004 (MX) ..... PA/a/2004/002843

(51) Int. Cl.

| | |
|---|---|
| ***H01B 11/00*** | (2006.01) |
| ***H01B 13/22*** | (2006.01) |
| ***H01B 11/04*** | (2006.01) |
| ***H01B 11/02*** | (2006.01) |
| ***H01B 11/08*** | (2006.01) |
| ***H01B 13/06*** | (2006.01) |

(52) U.S. Cl.

CPC ..... *H01B 11/04* (2013.01); *H01B 11/007* (2013.01); *H01B 11/02* (2013.01); *H01B 11/08* (2013.01); *H01B 13/06* (2013.01); *H01B 13/22* (2013.01); *Y10T 29/49194* (2015.01)

(58) Field of Classification Search

CPC ..... H01B 11/04; H01B 11/007; H01B 11/08; H01B 13/06; H01B 13/22; H01B 11/00; H01B 11/02; Y10T 29/49194

USPC ..... 174/113 R, 116, 27, 36, 103, 40 R, 350, 174/107, 106 R; 29/868, 592.1

See application file for complete search history.

(56) References Cited

U.S. PATENT DOCUMENTS

| | | | | |
|---|---|---|---|---|
| 3,297,814 A * | 1/1967 | McClean | ..... | H01B 11/06 174/106 R |
| 3,581,523 A * | 6/1971 | Bartholomew | ..... | F16C 1/06 464/52 |
| 6,495,762 B2 * | 12/2002 | Arzate | ..... | H01B 11/02 174/113 R |

*Primary Examiner* — Angel R Estrada

(74) *Attorney, Agent, or Firm* — Carmen Pili Ekstrom

(57) ABSTRACT

The invention relates to a method for manufacturing reinforced overhead multipurpose cable for outside telecommunications of Voice, Video, and Data Distribution (VVDD) type. The reinforced overhead multipurpose cable comprises a dry and multipair construction core, electromagnetic shielding elements and external protection thermoplastic cover, characterized because it includes one or several externally placed metal or plastic supporting elements for cable self-support; a core integrated by insulated electrical conductors of 2 to 300 twisted pairs, formed with twisting closed lay lengths and reduced in the formation of said component pairs; a plastic tape helicoidally arranged; a tape wrapping the assembled core; said tape being of aluminum for electromagnetic shielding and an external insulating cover both for the core and the reinforcement element, the dry core does not affect the conductance or capacitance or resistance of the insulation.

20 Claims, 6 Drawing Sheets

METHOD FOR MANUFACTURING A REINFORCED OVERHEAD MULTIPURPOSE CABLE FOR OUTSIDE TELECOMMUNICATION

This is a divisional patent application of U.S. patent application Ser. No. 10/898,509, filed on Jul. 22, 2004.

BACKGROUND OF THE INVENTION

1. Field of the Invention

The instant invention relates to the development of a method for manufacturing an overhead multipurpose cable for outside telecommunication, of Voice, Video, and Data Distribution (VVDD) type, longitudinally and externally reinforced with a support vein, permitting the obtainment of a telephone cable with larger bandwidth levels of operation, and conserving the operation frequencies for voice transmission.

2. Previous Art

The communication cables for interior use based on metal conductors, with polyolefin insulation, formed in pairs and without shielding insulating them against electromagnetic interferences have shown an ever faster development in such a way that today they can be used in frequency ranges of up to 250 MHz, according to US specifications Nema WC 66-99. The field of application of said cables has basically been the local area networks (LAN), houses, apartment buildings or industrial buildings, public buildings, intelligent buildings or schools. The growth of local area networks has caused that the users of digital services such as internet, video on demand, high definition television, teleconferences, voice and fax services, request telephone networks having the adequate flexibility to give said services with high quality and higher transmission speeds that the ones currently available in the outside plant telephone cables which have not evolved much with regard to technical changes.

Innovations regarding telecommunication cables are known. For example, U.S. Pat. No. 5,739,473 describes a flame retardant telecommunication cable for use in office buildings; said cable consists of a conductor array insulated in groups of twisted pairs and the insulation used in the core group is different from the insulation used in the surrounding groups, its main characteristic being the arrangement of its structure and the use of a fluorinated copolymer. U.S. Pat. No. 4,319,071 describes a telephone communication cable with a large number of pairs of small conductors, the main characteristic of which is a liquid filling based on waterproof paraffin oils.

The instant invention is an improvement on Mexican patent application PA/a/2000/006808, which relates to a multiple purpose telephone cable with operation levels of larger bandwidth, from 0 to 100 MHz together with the maintenance of operation frequencies for voice transmission.

The voice, video, and data distribution (VVDD) cables show an improvement with regard to the electromagnetic interference levels between adjacent pairs or between the sector or groups constituting the cable and multipair telecommunication cables are obtained with constructions that can include from 2 to 600 pairs.

The geometrical formation of the cables can vary depending on the final installation of said cables. Said installation can be directly underground or in telephone ducts in case of geometrically rounded cables.

The characteristics of the improved cable relate to its use, i.e., the cable is designed for overhead use and thus said cable does not have filling preventing moisture penetration such as gel materials or can contain swellable powder. Thus, it does not affect the efficiency of the conductance, capacitance or insulation resistance, and also relates to the self supporting capacity of the cable, related with the weight which depends on the number of the twisted pairs included in the cable design which is generally lower compared to the number of pairs for cables for ducts or underground purposes.

The overhead cable of the present invention provides higher current carrying capacity, i.e., maximum amount of electrical current a conductor can carry before sustaining immediate or progressive deterioration, as compared to underground cable. The current carrying capacity depends on several factors such as insulation temperature rating, electrical resistance, frequency of current, ambient temperature and ability to dissipate heat. Overhead cables have higher current carrying capacity because heat can dissipate into the air, and wind can improve the rate of thermal dissipation.

DESCRIPTION OF THE INVENTION

Hereinafter, the invention will be described with reference to the drawing of FIGS. 1 to 4, 5*a, b, c* and 6, wherein.

Figure 5:
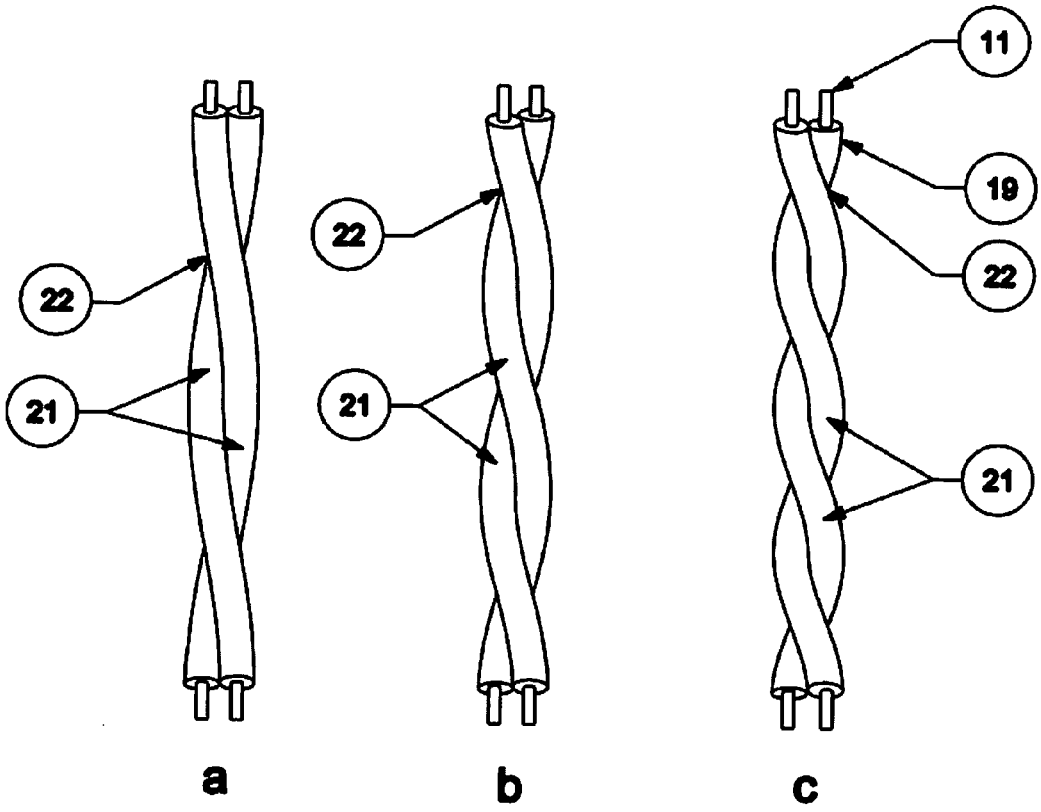

FIGS. 5*a, b, c* are front views showing the difference regarding the twisting pitches in pairs a, b and c.

Figure 6:
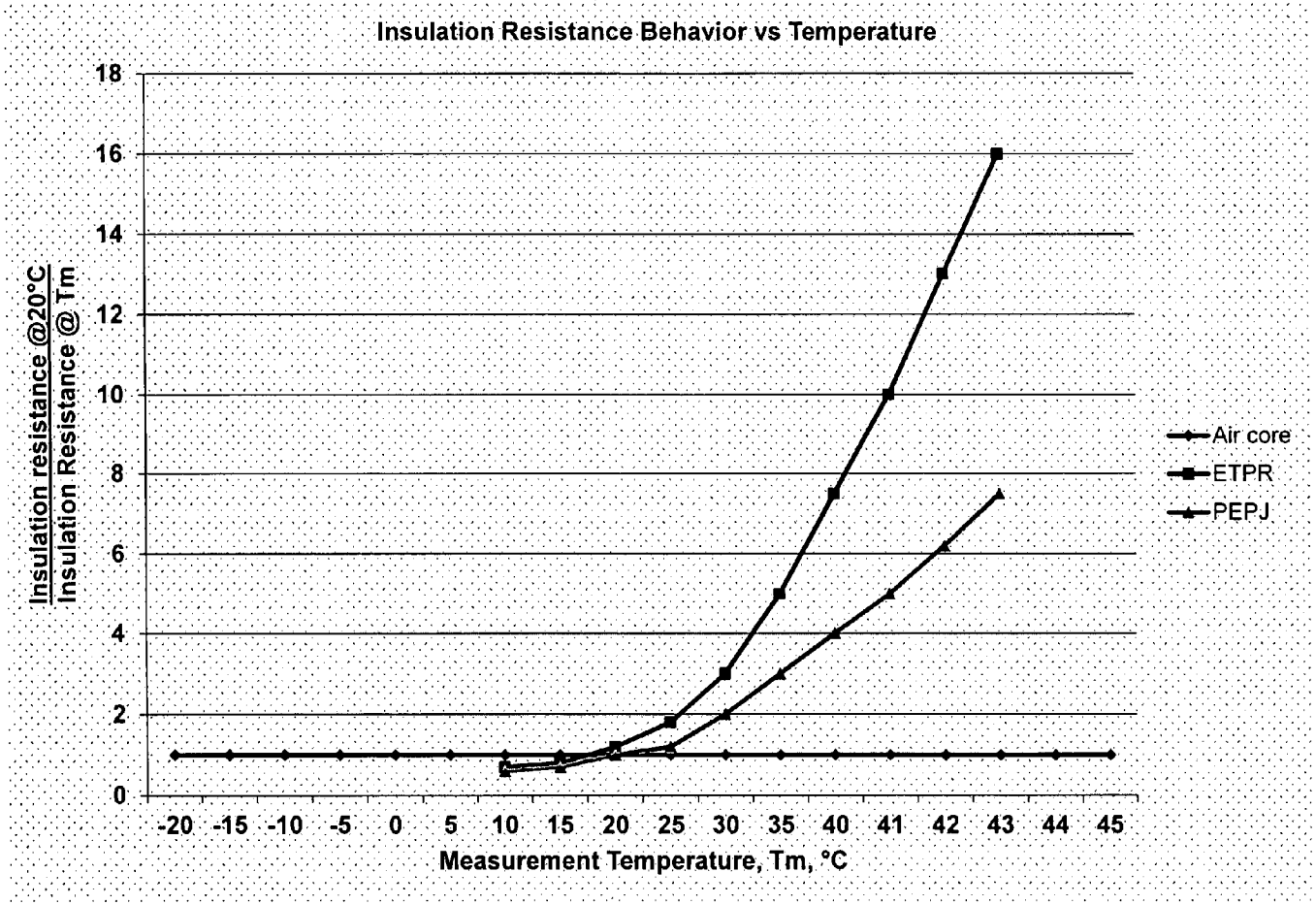

FIG. 6 is a chart showing the performance of insulation versus temperature.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

As used herein, the aluminum wrapping tape refers to element 16. The aluminum wrapping tape is tubularly arranged as "electromagnetic shielding element." When element 16 is applied as a smooth or corrugated using manufacturing methods known in the art, the element is transformed to a shield or an internal or external wall and refers to element 23.

As used herein, the terms "self-supporting member" and "reinforcing element" refer to element 24. The terms are interchangeable.

As used herein, the terms "external thermoplastic protection cover" "polyolefinic material plastic layer" and "insulation" are interchangeable and refer to element 19.

As used herein, the terms "cable sheath", "external cover" or "insulating external cover" are interchangeable and refer to element 17.

As used herein, the term "external integrated cover", "integral cover" or "outer insulating cover" are interchangeable and refer to element 25.

As used herein, the terms "sectors", "sections" or groups are interchangeable.

As used herein, "paradiaphony", diaphony or "crosstalk" effect is a phenomenon which refers to a signal transmitted from one circuit or a channel of a transmission a transmission system which creates an undesired effect in another circuit or channel. It is usually caused by undesired capacitive, inductive, or conductive coupling from one circuit, part of a circuit, or channel, to another. It is often distinguishable as pieces of speech or signaling tones leaking from other people's connections. The present invention eliminates paradiaphony, diaphony and/or crosstalk by providing shorter (optimized) pairing lay lengths as compared to conventional outside plant telephone cables. The length reduction of pairing lay lengths allows the cable to have the capacity to be used in larger bandwidth. Through the reduction of pairing lay lengths, a cable is obtained having better balanced pairs which minimizes the effect of electromagnetic induction among pairs of same group and among pairs of different groups. Appropriate shielding, wiring and insulation of the cables were also employed to eliminate the said phenomenon.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The cables for applications in Voice, Video and Data signals Distribution (VVDD) present the same design and manufacturing technology of varying the twisting lay lengths to lower the diaphony effect when high frequency signals circulate through twisted pairs (up to 100 MHz) as is the case in equivalent cables for duct applications. However, the overhead cables have a lower pair capacity because of the weight factor, i.e. the capacity varies between 2 and 300 pairs and they are not filled with flooding compounds preventing moisture penetration because as they are overhead cables, they are not exposed to flooding phenomena as in the case of underground cables. It has also been shown that the flooding compound would have a negative impact on overhead cables because during hot sunny days, there is a cable temperature increase and this situation increases the temperature of the flooding compound which in turn causes an increase of the compound dielectric constant, as well as, an increase of the transmission parameters such as attenuation resulting in higher signal losses in the cable and eventually connection failures because of network unbalance, or insulation resistance.

The VVDD-type cables of the instant invention are reinforced with a support element which is a carbon steel cable of one or several strands permitting flexibility when the breaking load has to be increased because of the weight of the cable. The weight of the cable depends on the capacity of the cable as well as the gauge of its conductors. The support element of the cable is united to the cable through an integral cover but separated from the core of transmission pairs through a vein or tie.

The cable of the instant invention is also electrically improved, especially with regard to paradiaphony values and electromagnetic interference levels among the groups. The interference level among adjacent sectors or groups in the same cable usually has a minimum value of 9 db (decibels) in order to ensure a better electric performance compared to the electromagnetic interference levels currently known in conventional telephone cables.

To improve the cable electric characteristics, "shorter" (optimized) pairing lay lengths are used, compared to conventional outside plant telephone cables. The length reduction of the pairing lay lengths allows the cable to have the capacity to be used in a larger bandwidth because through the reduction of the pairing lay lengths, a cable is obtained having better balanced pairs which minimizes the effect of electromagnetic induction among pairs of the same group and among pairs of different groups (a smaller number of disturbers). For this reason, the cable can be used in transmission systems integrating services where better and larger transmission qualities are requested at higher speeds, as well as pair multiplexion. Examples of services where said cables can be used are: ISDN (Integrated Service Digital Network), ISBDN (Integrated Services Bandwidth Digital Network), xDSL (Digital Subscriber Line), and other services. The design of the cable includes diaphony values in operation frequencies up to 100 MHz.

The increase of the operation bandwidth of the VVDD cables permits to increase the number of signals or transmissions circulating through the twisted pairs constituting the cable. The metal conductor used as core conductor in this type of cables shows a smooth and uniform superficial finishing as well as a constant diameter contributing globally to the fact that the cable can offer better attenuation values and entrance impedance as well as characteristics, which are also important factors in the performance of the electric cable. In the same way, the insulating material extruded on the core conductor shows 10% maximum eccentricities in the total of the insulated conductors, which contributes to generate better mutual capacitance values, having a positive impact on the final results, especially with regard to the electromagnetic interference levels (paradiaphony) among adjacent pairs in the same group or among pairs of different groups or sectors in the finished cable.

The above mentioned improvements together with the optimized pairing lay lengths (with narrow tolerances), and the random assembly of the pairs and the final cabling of the groups or sectors, combine to offer as a result a VVDD telecommunication cable with improved electrical performance and better self supporting capacity.

The above explanation means that the pairs constituting the cable show a better sizing throughout its length and a lower mechanical wear during the manufacturing process, permitting as a global result the lowering of the electromagnetic interference levels (paradiaphony) among pairs, sectors or groups in a given cable, providing as a consequence a cable that can operate within a much wider range of frequencies (0-100 MHz).

The overhead VVDD cable object of the instant invention is a dry core cable, i.e., it does not include hygroscopic filling material among the components or conductors forming the finished cable, or can contain a powder swellable material as remote prevention agent against moisture in the overhead insulation which does not affect the conductance or capacitance or resistance of the insulation, because it is one of the cable electrical parameters that show important changes because the temperature and the presence of materials preventing moisture penetration such as gels, as can be seen on the diagram of FIG. 6. The diagram is a graph of insulation resistance at measurement temperature, TM ° C. The graph demonstrates the relationship of air core, extended thermoplastic rubber (ETPR) and polyethylene modified petroleum jelly (PEPJ) with respect to insulation resistance. The insulation resistance of ETPR and PEPJ increased at 16 and 7.5 respectively while the insulation resistance of the air core remained steady at 1.0. Thus, the presence of ETPR and PEPJ has significant effect on insulation resistance.

Figure 1:
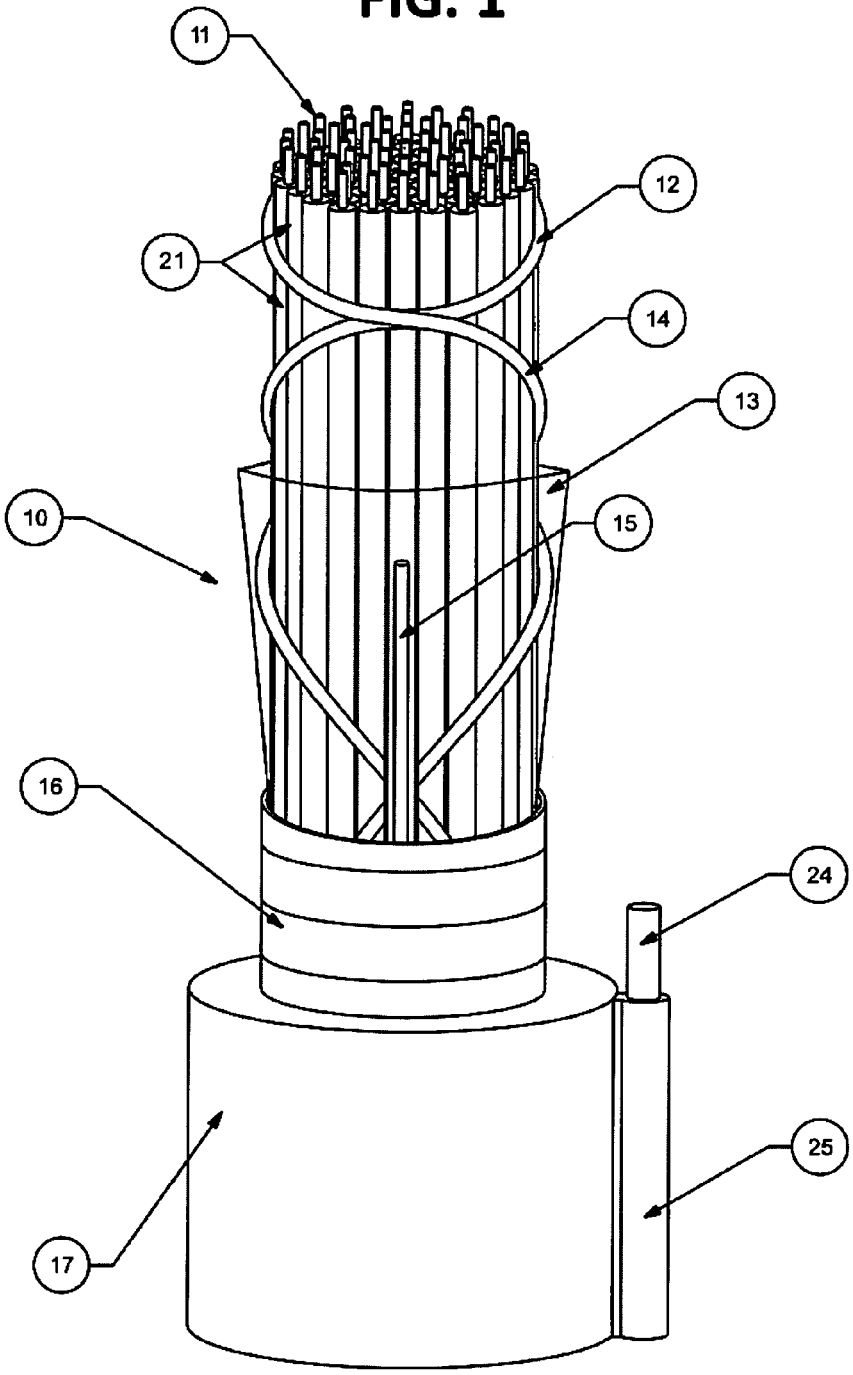
FIG. 1 is a cross sectional front view showing the different sections constituting the overhead reinforced multipurpose cable for outside telecommunications.
Figure 2:
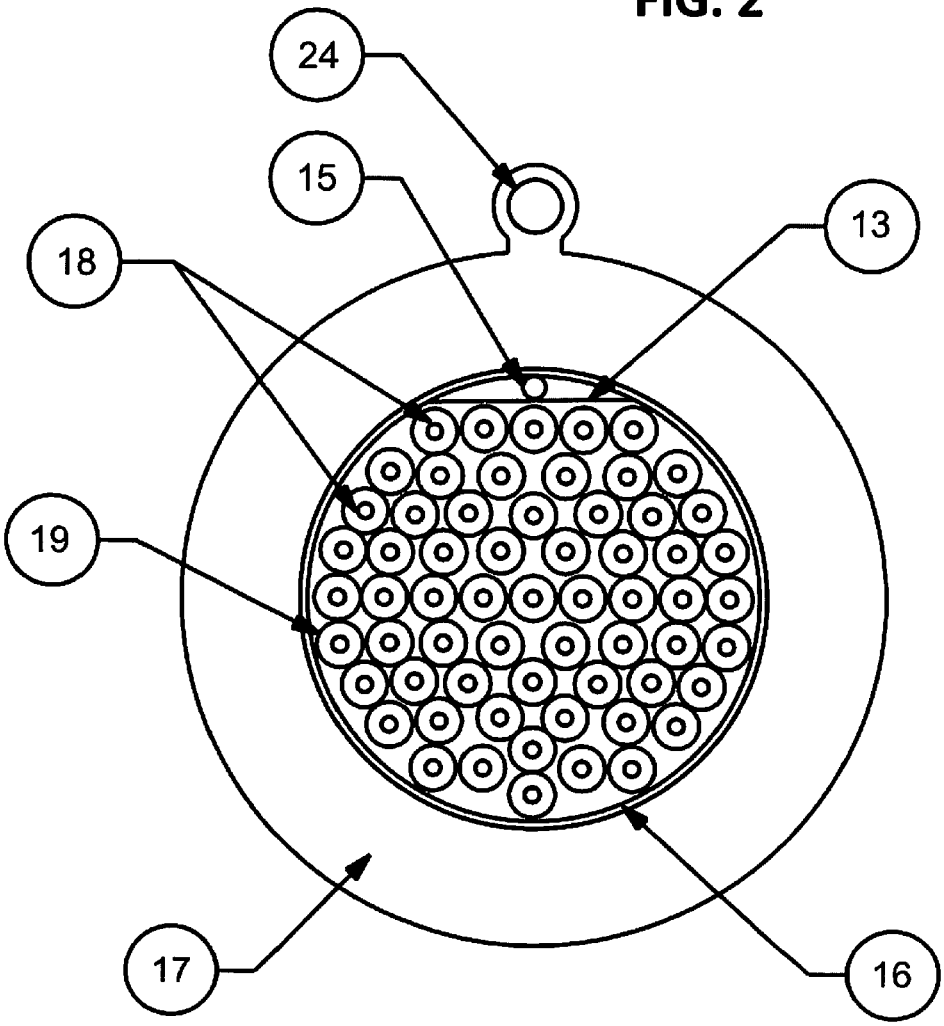
FIG. 2 is a cross sectional view of the cable of FIG. 1.
Figure 4:
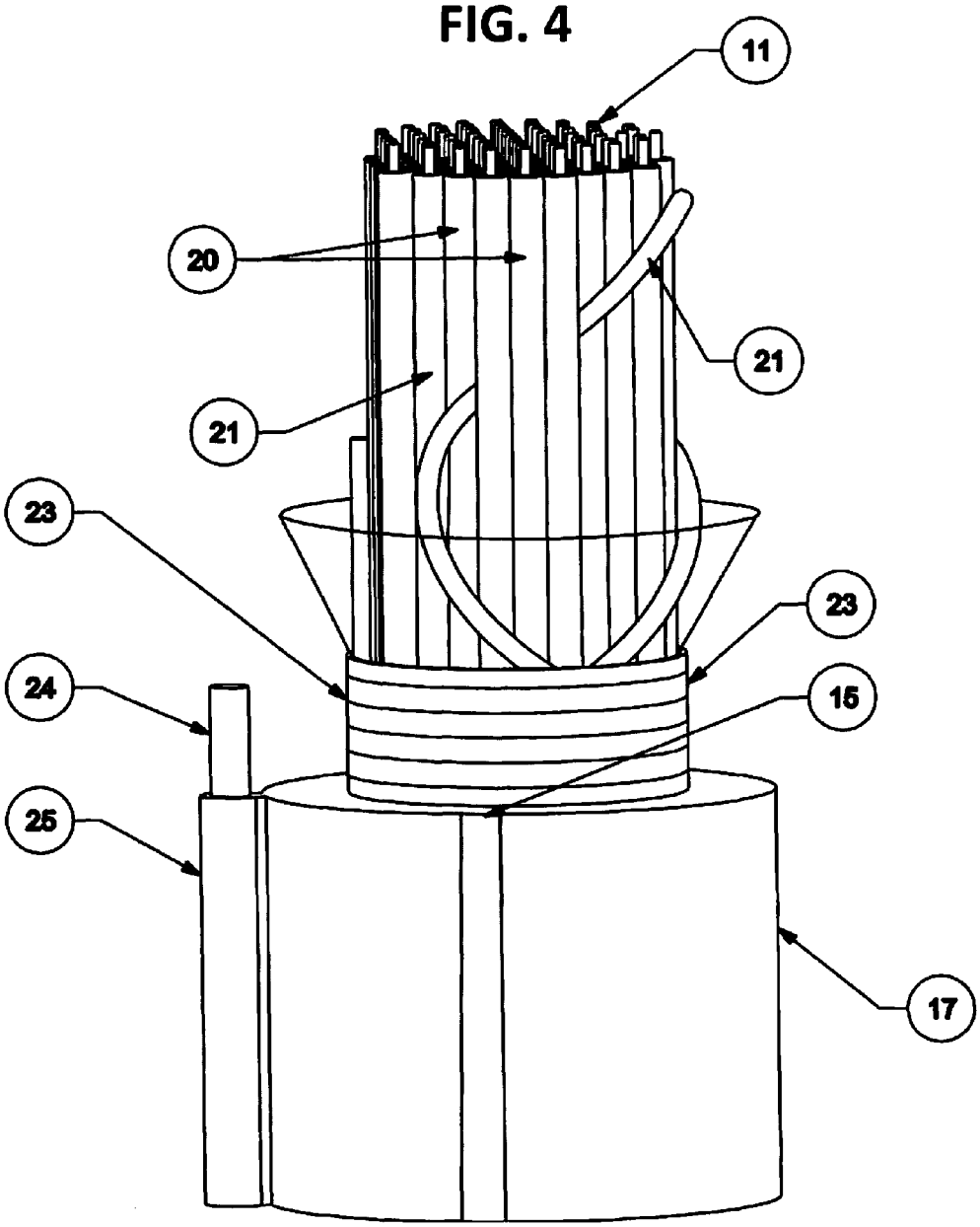
FIG. 4 is a front view of the multipair construction of the reinforced core of FIG. 1.

The multiple purpose overhead cable for outside telecommunications 10, FIG. 1, object of the instant invention, has a sectioned cylindrical shape with a longitudinal appendix 24 extruded at the sheath 17, and practically without spaces, i.e. without interstices because of the way the pairs of conductors are united, said cable comprises the following parts: several electric conductors 11, made of metal for telecommunications purposes forming the main core of the outside plant cable 10, in 19, 22, 24 and 26 AWG gauges; insulated with a polyolefinic material plastic layer 19, FIG. 2, presenting a minimum conductor eccentricity, being said core characterized by constructions from 2 to 300 twisted pairs 21, FIG. 1, formed with optimized twisting lay lengths different among them, FIGS. 5*a, b, c*, 22 and components of the groups or sectors of the finished cable, permitting an important reduction of the electromagnetic interference levels (paradiaphony in db). This is obtained through a careful selection of the twisting lay lengths involved and a random assembly of the pairs to finally form the groups or sectors 20, FIG. 4, of the cable components 10, FIG. 1.

Figure 3:
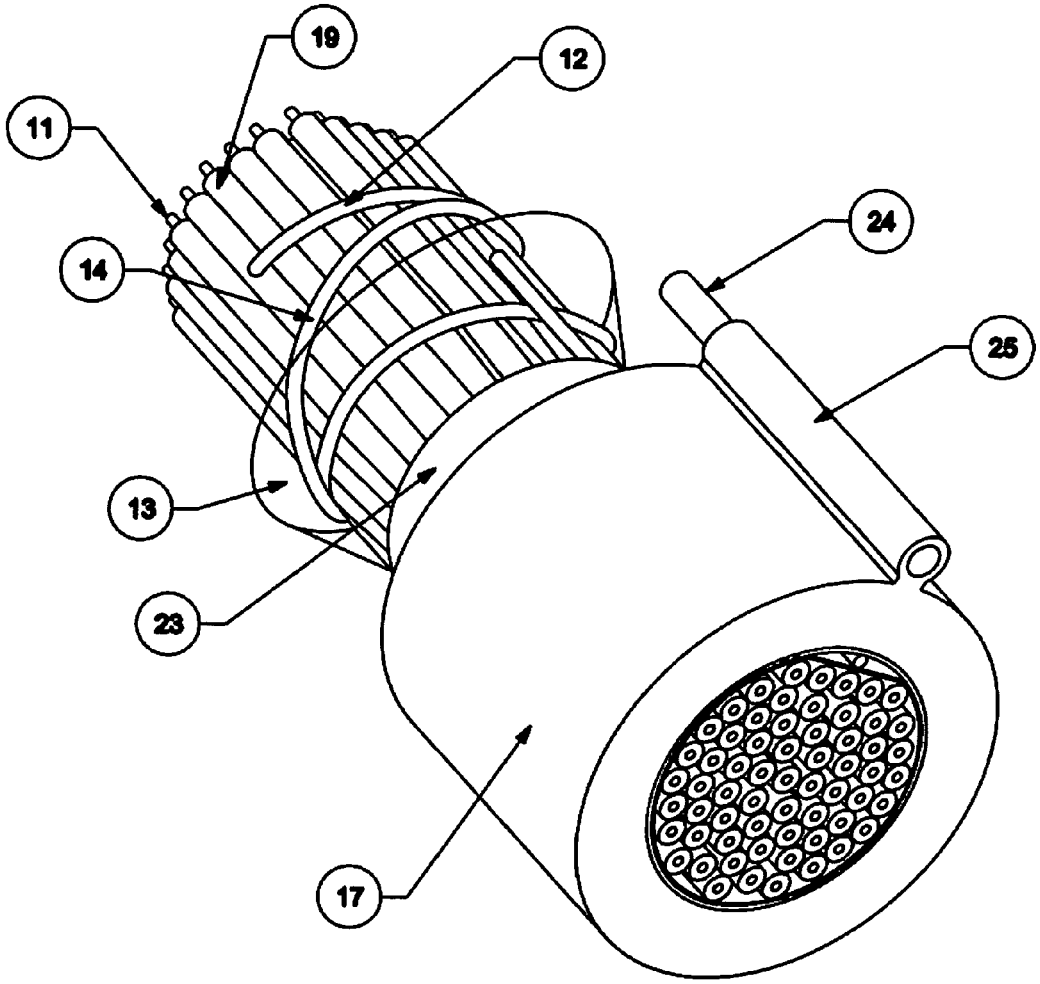
FIG. 3 is an exploded isometric view of FIG. 1 showing the multipair groups in their different arrangements and a self supporting reinforcement element.

An important additional factor to obtain higher electrical results is the fact that the tolerances of the twisting lay lengths in the pairs are kept within a minimum variation range (generally ±1 mm). The object of said minimum variation range is that if during the random assembly, pairs with similar twisting lay lengths are in contact, no phenomenon of transmission area invasion is produced with the corresponding generation of electromagnetic induction; a plastic tape for the union 12 and 14 of the array of pair sectors 21, FIG. 1, a plastic wrapping tape 13, FIG. 3 as fastening element for the united core; a rupture thread 15, projecting longitudinally along the cable 10, and an aluminum wrapping tape 16, concentrically arranged with regard to the core with corrugated or smooth internal and external walls 23 to inhibit the penetration or exit of electromagnetic radiation, an insulating external cover 17 based on low and medium density polyolefins; a reinforcing element 24 for cable self support 10, said reinforcing element being made of carbon steel formed by filaments of only one gauge or several gauges to form the desired gauge or formed by several high resistance and flexible plastic elements according to the requested cable weight. Said reinforcement and support element is extruded with an integral cover 25 and externally extruded to the cable sheath 17.

Manufacturing Process of the Multipurpose Cable for Outside Telecommunications:

The basic parts constituting the overhead multipurpose cable of the instant invention according to FIGS. 1 to 6 of the drawings are the following ones:

Softly tempered metal conductor 11, FIG. 1, 19, 22, 24, and 26 AWG gauges, with insulation 19 made of solid, or foamed with solid layer protection polyolefin, with adequate thickness to meet the requested electrical parameters;

Assembly elements 12, 14 to fasten and identify the different sectors or groups of twisted pairs constituting the complete cable;

Dry core. The cable does not need non-hygroscopic material filling. This fact diminishes the weight of said cable and compensates partially the weight of the reinforcement element.

Shield 23, according to the case. This component is usually applied as a smooth, FIG. 3, or corrugated, FIG. 4, longitudinal shape. The overhead installation of the cable prevents the corrosion of the metal materials involved.

External cover 17 made of material based on low or medium density polyolefins.

Manufacturing Process:

The manufacture of the cable is conducted according to the following steps: a) tandem process, i.e., drawing-insulation, in which the copper wire passes through a series of drawing dies where it is submitted to successive transversal area reductions in order to obtain the final diameter of the design (19, 22, 24, 26 AWG); in this same step, the core conductor already at its final size is annealed to change its temper from hard to soft, in this way an at least 15% elongation is obtained; b) after the annealing of the material, it is guided to an extruder in which the wire is forced through an extrusion head in which the guide and the extrusion die are located, which is the part that determines the size of the final diameter of the insulation. Said sizing occurs at the time when the solid or foamed insulation material with a solid protection layer is extruded through the extruder existing in the process line to the extrusion die. It is also in this stage that the eccentricity level between the metal conductor and the insulation applied is checked in such a way that it is 10% maximum.

The step of pairing VVDD cables with fewer than 10 pairs is conducted separately and then the pairs are cabled in order to obtain the final configuration. The pairing and the cabling steps are selected in such a way that the electromagnetic induction (paradiaphony) between pairs of a group or groups or different sectors are minimized, which gives as a result a higher electrical performance, especially with regard to paradiaphony. In the step of pairing-cabling cables with a number of pairs ≥10, the insulated conductors are assembled in pairs with optimized pairing lay lengths to ensure a high electrical performance of the cable, especially with regard to the paradiaphony parameter among pairs of the same group or among pairs of different groups or sectors.

After forming the pairs, said pairs are grouped in sector of 10 pairs, in the case of cables with up to 100 pairs or in groups (5 sectors of 10 pairs) of 50 pairs in the case of cables with 150 to 300 pairs. The sectors or groups are guided thorough the assembling devices to be cabled and to form the core final assembly. The application of the external cover based on low and medium density polyolefins, is also applied in an extruder, using for this purpose guides and extrusion dies according to the final dimension of the cable.

Alternatively, the reinforcing element previously assembled with several wires or plastic fibers is extruded together with the sheath but separately from the cable core. The self supporting elements can be one or several elements depending on the weight of the twisted pairs used.

The above description of the present invention is intended to be illustrative and not to limit the scope of the claims.

The invention claimed is:

1. A method for manufacturing a reinforced overhead multipurpose cable for outside telecommunications, of voice, video, data and distribution (VVDD) type, said cable comprising a dry core, said method comprising the steps of:

constructing a multipair construction core;

arranging tubularly a plurality of electromagnetic shielding element comprising aluminum wrapping tape; applying said element as a smooth or corrugated surface to form a shield or internal or external wall;

passing an external thermoplastic protection cover comprising polyolefin through an extruder using guides and extrusion dies;

extruding a self-supporting reinforcing element comprising carbon steel formed by one or a plurality of twisted filament metal elements which are united and externally extruded at the sheath comprising polyolefins; said self-supporting reinforcing element without spaces or interstices;

uniting said self-supporting reinforcement element to the main sheath of the cable in the external integrated cover of the cable but separated from the core of transmission pair sections through a vein or tie; said filament metal elements providing flexibility to the cable when necessary to increase the breaking load because of the weight of the cable itself;

arranging a plastic tape helicoidally and longitudinally arranged to unite the individual arrays of pair sectors forming the core;

covering concentrically with a plastic wrapping tape said assembled core;

projecting longitudinally a rupture thread longitudinally projecting along the cable; and adjacent to an aluminum wrapping tape of said cable;

integrating the core with insulated electrical conductors constructions comprising 2 to 300 twisted pairs formed with optimized twisting shorter lay lengths to allow the cable to enhance its transmission characteristics and transmit improved signals;

forming a dry core which is free from fillings, or swellable powder in the interstices of the core, such that the efficiency of conductance, capacitance or resistance of the insulation is not affected;

producing an overhead cable with low pair capacity because of weight factor configuration.

2. The method for manufacturing a reinforced overhead multipurpose cable for outside telecommunications according to claim 1, further comprising providing electrical conductors comprises metal conductors made of copper selected from the group consisting of 19, 22, 24 and 26 AWG gauges.

3. The method for manufacturing a reinforced overhead multipurpose cable for outside telecommunications according to claim 1, further comprising closing the gap of twisting of pairs between lays, thus preventing a major reduction of the twisting lay lengths which is obtained through a random assembly of the pairs constituting the groups or sectors forming multipair cable construction.

4. The method for manufacturing a reinforced overhead multipurpose cable for outside telecommunications according to claim 1, further comprising reducing the twisting lay lengths in the component pairs to about 45% which is lower than in conventional outside plant telephone cables.

5. The method for manufacturing a reinforced overhead multipurpose cable for outside telecommunications according to claim 1, further comprising reducing the twisting lay lengths such that it forms closed twisting permitting the decrease of magnetic interference levels.

6. The method for manufacturing a reinforced overhead multipurpose cable for outside telecommunications according to claim 1, further comprising keeping the tolerances of twisting lay lengths in the pairs within minimum variation average of about ±1 mm, to prevent electromagnetic induction and obtain high electrical performance.

7. The method of claim 6 wherein the minimum variation range if during the random assembly, pairs with similar twisting lay lengths are in contact, no phenomenon of transmission area invasion is produced with the corresponding generation of electromagnetic induction.

8. The method for manufacturing a reinforced overhead multipurpose cable for outside telecommunications according to claim 1, further comprising improving the cable paradiaphony levels in an electromagnetic induction of 9 db and operating at frequencies within a range of 0-100 MHz of a larger bandwidth.

9. A method for manufacturing a reinforced overhead multipurpose cable for outside telecommunications, of voice, video, data and distribution (VVDD) type according to claim 1, comprising the following steps:

passing the copper wire through a series of drawing dies;

submitting the wire to successive transversal area reduction to obtain a sized core;

annealing the sized core to change its temper from hard to soft to obtain at least 15% elongation;

guiding the annealed material through an extruder in which the wire passes through an extrusion head in which the guide and the sizing extrusion die are located, in order to determine the final diameter of the insulation;

extruding the solid or foamed insulation material with solid protection layer from the extruder existing in the process line up to the extrusion die such that extrusion occurs with sizing;

applying insulation such that the eccentricity level between the metal conductor and the applied insulation thickness is 10% maximum;

providing paradiaphony parameter among pairs of one group among pairs of different groups or sectors and after formation of pairs, said groups are paired in sectors of 10 pairs, in case of cables up to 100 pairs or in groups (sectors of 10 pairs) of 50 pairs in cables comprising 150 to 300 pairs;

guiding the sectors or groups through assembly devices to be cabled and to form final core assembly.

10. The method for manufacturing a reinforced overhead multipurpose cable for outside telecommunications according to claim 9, further comprising obtaining a final diameter of the conductor selected from the group consisting of 19, 22, 24, 26 AWG gauge.

11. The method for manufacturing a reinforced overhead multipurpose cable for outside telecommunications according to claim 9, further comprising conducting the pairing of VVDD cables with fewer than 10 pairs separately and cabling the pairs in order to obtain a final configuration.

12. The method for manufacturing a reinforced overhead multipurpose cable for outside telecommunications according to claim 11, further comprising pairing the cables in order to obtain a DNA configuration, the pairing lays are nearly closed, and cabled, selected in such a way that electromagnetic induction (paradiaphony) is minimized between pairs of a group or between different groups or sectors to produce a higher electrical performance, with regard to paradiaphony.

13. The method for manufacturing reinforced overhead multipurpose cable for outside telecommunications according to claim 12, wherein in the pairing-cabling step of cables with a number of pairs ≥10, further comprising uniting insulated conductors in pairs with practically closed pairing lays in order to insure high electrical performance of the cable.

14. The method for manufacturing a reinforced overhead multipurpose cable for outside telecommunications according to claim 9, further comprising reducing the twisting lay lengths in the component pairs at about 45% lower than conventional outside plant telephone cables to obtain shorter optimized pairing lay lengths.

15. A reinforced overhead multipurpose cable for telecommunications prepared by the method of claim 1.

16. The method of claim 1 further comprising insulating said conductor with a plastic layer comprising polyolefinic material, wherein the metal conductor has a low 10% maximum eccentricity with regard to the size of the final diameter of the insulating layer.

17. The method of claim 1 further comprising reducing electromagnetic interference levels by selecting twisting lay length involved and assembling randomly of pairs to finally form the group or sectors.

18. The method of claim 17 wherein in the step of pairing-cabling cables with a number of pairs greater or equal to 10, further comprises assembling the insulated conductors in pairs with optimized pairing lay lengths to ensure high electrical performance of the cable, such as paradiaphony parameter among the pairs of same group or among pairs of different groups or sector.

19. The method of claim 1 further comprising providing paradiaphony parameter among pairs of one group among pairs of different groups or sectors and after formation of pairs, said groups are paired in sectors of 10 pairs, in case of cables up to 100 pairs or in groups (sectors of 10 pairs) of 50 pairs in cables comprising 150 to 300 pairs.

20. The method of claim 1 wherein the reinforcement self-supporting element is extruded with an integral cover and externally extruded to the cable sheath; said self-supporting element comprising filaments of only one gauge or several gauges to form the desired gauge or formed by several high resistance and flexible plastic elements according to the cable weight.

* * * * *